US006464315B1

(12) United States Patent
Otokita et al.

(10) Patent No.: US 6,464,315 B1
(45) Date of Patent: Oct. 15, 2002

(54) DRIVING METHOD FOR INK JET RECORDING HEAD AND INK JET RECORDING APPARATUS INCORPORATING THE SAME

(75) Inventors: Kenji Otokita; Satoru Hosono, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/494,419

(22) Filed: Jan. 31, 2000

(30) Foreign Application Priority Data

Jan. 29, 1999 (JP) ..... 11-023314
Sep. 14, 1999 (JP) ..... 11-261186
Dec. 28, 1999 (JP) ..... 11-375308

(51) Int. Cl.[7] ..... B41J 29/38
(52) U.S. Cl. ..... 347/9; 347/11
(58) Field of Search ..... 347/9–11, 68

(56) References Cited

U.S. PATENT DOCUMENTS

| | | | | | |
|---|---|---|---|---|---|
| 4,491,851 | A | * | 1/1985 | Mizuno et al. | 347/11 |
| 4,523,200 | A | | 6/1985 | Howkins | |
| 4,593,291 | A | | 6/1986 | Howkins | |
| 5,495,270 | A | | 2/1996 | Burr et al. | 347/10 |
| 5,576,743 | A | * | 11/1996 | Momose et al. | 347/11 |
| 5,631,675 | A | * | 5/1997 | Futugawa | 347/10 |
| 5,689,291 | A | | 11/1997 | Tence et al. | 347/10 |
| 5,736,993 | A | | 4/1998 | Regimbal et al. | 347/11 |
| 5,980,015 | A | * | 11/1999 | Saruta | 347/15 |
| 6,092,886 | A | * | 7/2000 | Hosono | 347/10 |
| 6,312,077 | B1 | * | 1/2001 | Araki | 347/11 |

FOREIGN PATENT DOCUMENTS

| | | | | |
|---|---|---|---|---|
| EP | 0 548 984 A1 | | 6/1993 | B41J/2/045 |
| EP | 0 616 891 A1 | | 9/1994 | B41J/2/045 |
| EP | 0 739 598 A2 | * | 10/1996 | B41J/2/045 |
| EP | 0 812689 | | 12/1997 | B41J/2/045 |
| EP | 0 816 081 A2 | * | 1/1998 | B41J/2/045 |
| EP | 0 827 838 A2 | * | 3/1998 | B41J/2/21 |
| EP | 0-947-325 A1 | | 10/1999 | B41J/2/045 |
| EP | 1 004441 | | 5/2000 | B41J/2/049 |
| JP | 63-71355 | | 3/1988 | B41J/3/04 |
| JP | 1-275148 | | 11/1989 | B41J/3/04 |
| JP | 2-4512 | | 1/1990 | B41J/2/045 |
| JP | 2-192947 | | 7/1990 | B41J/2/045 |
| JP | 6-340075 | | 12/1994 | B41J/2/045 |
| JP | 9-52360 | | 2/1997 | B41J/2/045 |
| JP | 09 141851 | | 6/1997 | B41J/2/045 |
| JP | 9-226106 | | 9/1997 | B41J/2/01 |
| JP | 9-327908 | | 12/1997 | B41J/2/045 |
| JP | 11-20203 | | 1/1999 | B41J/2/205 |
| WO | WO 00 23278 | | 4/2000 | B41J/2/045 |

OTHER PUBLICATIONS

Patent Abstract of Japan 1–275148 Nov. 2, 1989.
Patent Abstract of Japan 2–192947 Jul. 30, 1990.
Patent Abstract of Japan 2–4512 Jan. 9, 1990.
Patent Abstract of Japan 06340075 Dec. 13, 1994.
Patent Abstract of Japan 09052360 Feb. 25, 1997.
Patent Abstract of Japan 09226106 Feb. 9, 1997.
Patent Abstract of Japan 11020203 Jan. 26, 1999.

* cited by examiner

*Primary Examiner*—Raquel Yvette Gordon
*Assistant Examiner*—Alfred Dudding
(74) *Attorney, Agent, or Firm*—Sughrue Mion, PLLC

(57) ABSTRACT

To provide an inkjet printer recording apparatus and a recording head used with the inkjet recording apparatus with a driving method capable of properly controlling the behavior of a meniscus at a nozzle orifice and stably jetting an extremely small ink drop through a nozzle orifice having a large diameter, a drive signal for ejecting any drop for forming a microdot consists of a charge element for largely pulling in a meniscus toward a pressure generating chamber, a discharge element for pushing out the meniscus slightly toward the nozzle orifice, and a charge element for pulling in the meniscus slightly toward the pressure generating chamber. The elements are connected in order in a drive signal.

31 Claims, 9 Drawing Sheets

DRIVING METHOD FOR INK JET RECORDING HEAD AND INK JET RECORDING APPARATUS INCORPORATING THE SAME

BACKGROUND OF THE INVENTION

This invention relates to an ink jet recording apparatus for recording an image, text, etc., on recording medium with a recording head and a driving method of an ink jet recording head and in particular to an ink jet recording apparatus adapted to jet an extremely small amount of ink drop capable of forming a microdot.

An ink jet printer is already well known as a representative ink jet recording apparatus. With the printer, the dot diameter on recording paper, namely, image quality (resolution) is determined by the amount of ink drop jetted from a recording head. Thus, to control the jetting amount of ink is important.

If the jetting amount of ink drop is controlled based on the diameter of a nozzle orifice, if the diameter is small, the resolution can be improved, but the recording speed becomes low; if the diameter is large, the recording speed can be increased, but a coarse image low in resolution is formed.

To meet such opposed requirements, there is an idea which can jet different volume of ink through the same nozzle orifice of a printer.

When an extremely small dot (microdot) is recorded by the printer, a pressure generating element such as a piezoelectric actuator is driven by a drive signal containing drive pulses appropriately for jetting different amounts of ink drops.

An ink drop is jetted using change in ink pressure in a pressure generating chamber accompanying expansion and contraction thereof.

By the way, more improvement in image quality has been demanded for recent ink jet recording apparatus. With the drive pulse in the related art mentioned above, a small amount of ink drop can be jetted. However, jetting a smaller amount of ink drop is demanded from the viewpoint of improvement in recording quality.

SUMMARY OF THE INVENTION

It is therefore an object of the invention to provide a driving method of an ink jet recording head capable of jetting an extremely small amount of ink drop, and an ink jet recording apparatus incorporating the same.

In order to achieve the above object, there is provided an ink jet recording apparatus comprising:

- a recording head including a piezoelectric actuator for varying the volume of a pressure generating chamber by the deformation thereof to eject an ink drop from a nozzle communicating with the pressure generating chamber; and
- a drive signal generator for supplying a drive signal supplied to the piezoelectric actuator to deform the same in accordance with the potential of the signal, the drive signal including:
  - a pull-in element for varying the potential of the drive signal such that the pressure generating chamber is expanded to pull in a meniscus of the ink in the nozzle thereto;
  - a first ejection element for varying the potential of the drive signal such that the expanded pressure generating chamber is partly contracted; and

- a second ejection element for varying the potential of the drive signal such that the contracted pressure generating chamber is expanded again to eject the ink drop from the nozzle.

Preferably, the drive signal includes:

- a pull-in hold element connecting an end potential of the pull-in element and a start potential of the first ejection element at the same potential; and
- an ejection hold element connecting an end potential of the first ejection element and a start potential of the second ejection element at the same potential.

Preferably, the potential difference of the second ejection element is equal to the potential difference of the first ejection element or less.

Preferably, the potential of the second ejection element at an end potential thereof is the potential of the first ejection element at a start potential thereof or less, and is higher than the end potential of the first ejection element at an end potential thereof.

Preferably, a duration of the pull-in element is matched up to a natural period of the pressure generating chamber.

Preferably, the drive signal includes a contraction element after the second ejection element for varying the potential such that the pressure generating chamber expanded by the second ejection element is contracted such an extent that an ink drop is not ejected from the nozzle.

Preferably, the contraction element includes at least two contraction elements and at least one contraction hold element connecting the preceding contraction element and the following contraction element at the same potential.

Preferably, the potential gradient of the following contraction element is equal to or less than the potential gradient of the preceding contraction element.

Preferably, the drive signal includes a previous contraction element for varying the potential such that the pressure generating chamber is once contracted before the application of the pull-in element.

Preferably, the drive signal includes a damping element for varying the potential such that the pressure generating chamber contracted by the contraction element is restored to an original volume thereof in order to stabilize the motion of the meniscus.

Preferably, the drive signal generator includes:

- an output voltage information storage for storing a potential value of the drive signal;
- a variation information storage for storing a variation amount of the potential of the drive signal; and
- a calculator for calculating a potential value based on at least the potential value stored in the output voltage information storage and the variation amount stored in the variation information storage.

The calculation result is loaded in the output voltage information storage every predetermined period while changing the variation amount stored in the variation amount storage to generate a drive signal programmably.

Preferably, the drive signal includes a second drive pulse for ejecting an ink drop heavier than the ink drop ejected by a first drive pulse defined by the pull-in element, the first ejection element and the second ejection element.

Preferably, the drive signal includes a third drive pulse for ejecting an ink drop heavier than the ink drop ejected by the application of the second drive pulse.

Preferably, the third drive pulse, the first drive pulse and the second drive pulse are arranged in order in the drive signal.

According to the present invention, there is also provided an ink jet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to deform the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle;

a second contraction element for varying the potential of the drive signal such that the pressure generating chamber is contracted again to stabilize vibration of the meniscus of the ink.

Preferably, a time period from a start end of the first contraction element to an end potential of the hold element is equal to a half of a natural period of the piezoelectric actuator.

Preferably, a time period from a start end of the first contraction element to an end potential of the second contraction element is equal to a natural period of the pressure generating chamber.

Preferably, the potential gradient of the first contraction element is steeper than the potential gradient of the second contraction element.

Preferably, the drive signal includes a second drive pulse for ejecting an ink drop heavier than the ink drop ejected by a first drive pulse defined by the pull-in element, the first contraction element, the hold element and the second contraction element.

Preferably, the drive signal includes a third drive pulse for ejecting an ink drop heavier than the ink drop ejected by the application of the second drive pulse.

Preferably, the first drive pulse and the second drive pulse are arranged in order in the drive signal.

Preferably, the drive signal includes a fourth drive pulse for vibrating the meniscus of the ink without ejecting the ink drop from the nozzle. The first and second drive pulses are preceded by the fourth drive pulse.

According to the present invention, there is also provided a method of driving a recording head including a nozzle communicating with a pressure generating chamber, from which an ink drop is ejected due to volume variation of the pressure generating chamber, comprising the steps of:

expanding the pressure generating chamber to pull in a meniscus of the ink in the nozzle thereto;

contracting partly the expanded pressure generating chamber; and expanding again the contracted pressure generating chamber to eject the ink drop from the nozzle.

According to the present invention, there is also provided a method of driving a recording head including a nozzle communicating with a pressure generating chamber, from which an ink drop is ejected due to volume variation of the pressure generating chamber, comprising the steps of:

expanding the pressure generating chamber to pull in a meniscus of the ink in the nozzle thereto;

contracting partly the expanded pressure generating chamber;

retaining the contracted state of the pressure generating chamber to eject the ink drop from the nozzle; and contracting again the pressure generating chamber to stabilize vibration of the meniscus of the ink.

DETAILED DESCRIPTION OF THE PREFERRED EMBODIMENTS

Figure 1:
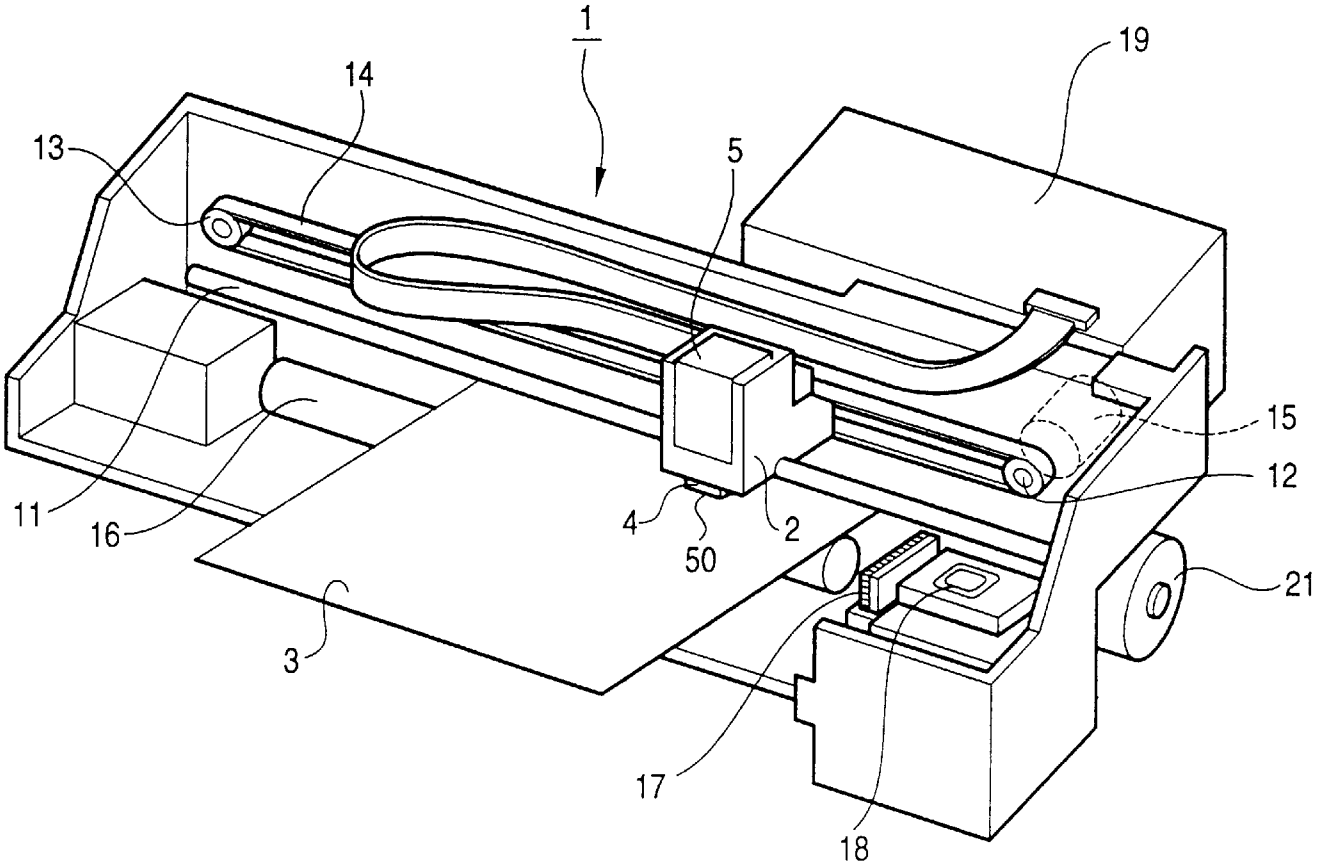
FIG. 1 is a perspective view of an ink jet recording apparatus according to a first embodiment of the invention.
Figure 2:
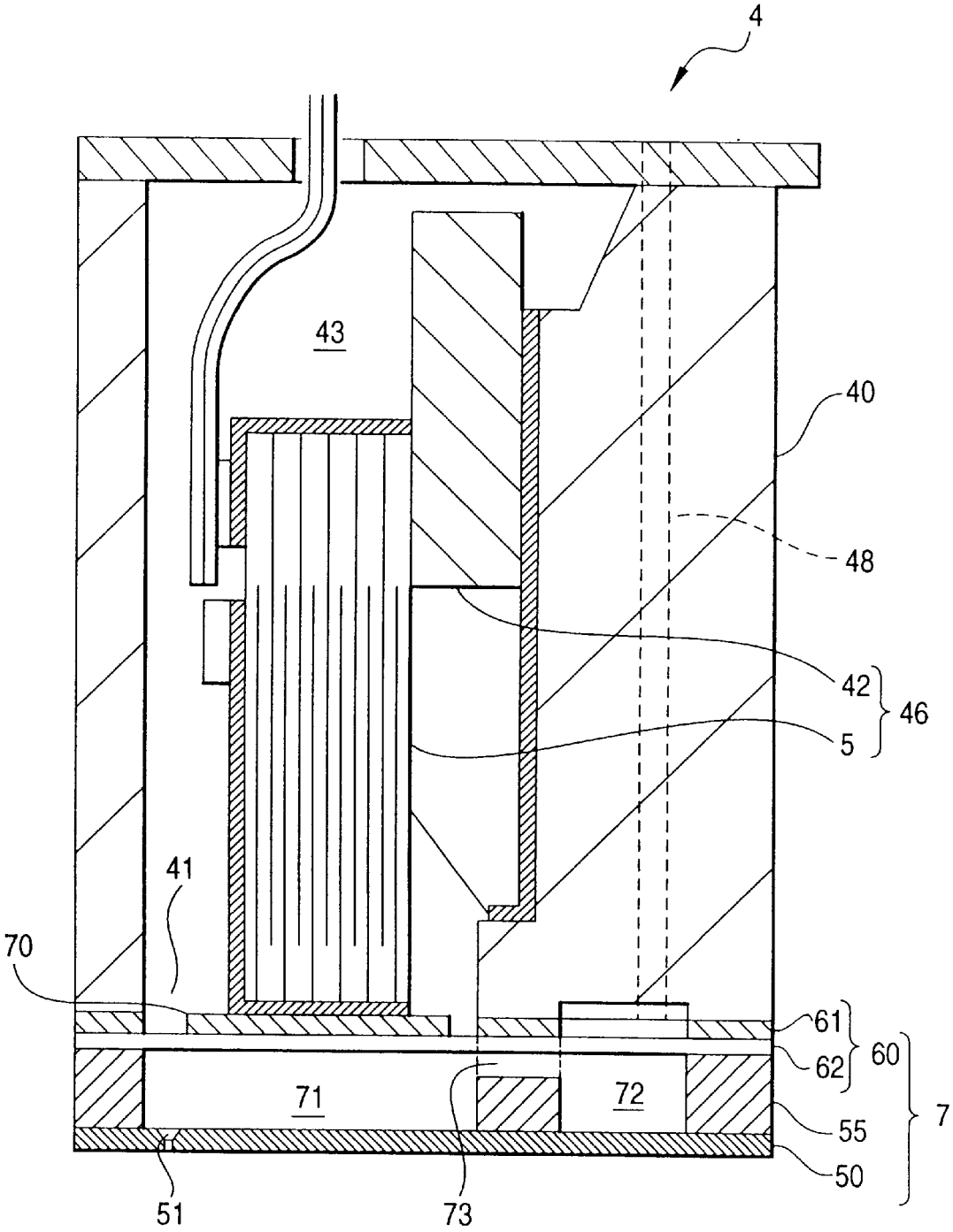
FIG. 2 is a sectional view to show a recording head.
Figure 3:
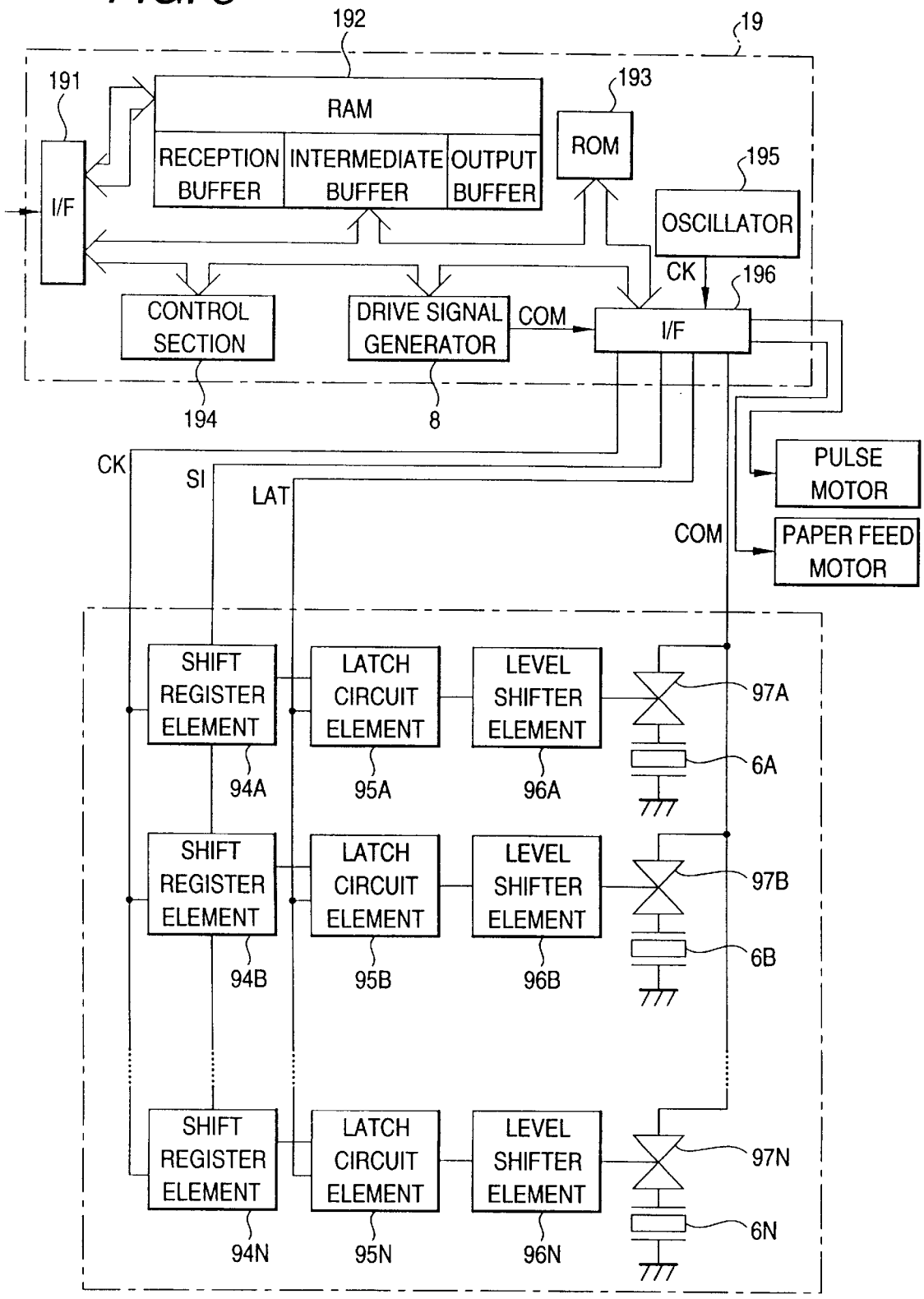
FIG. 3 is a block diagram to show the configuration of a control system.
Figure 4:
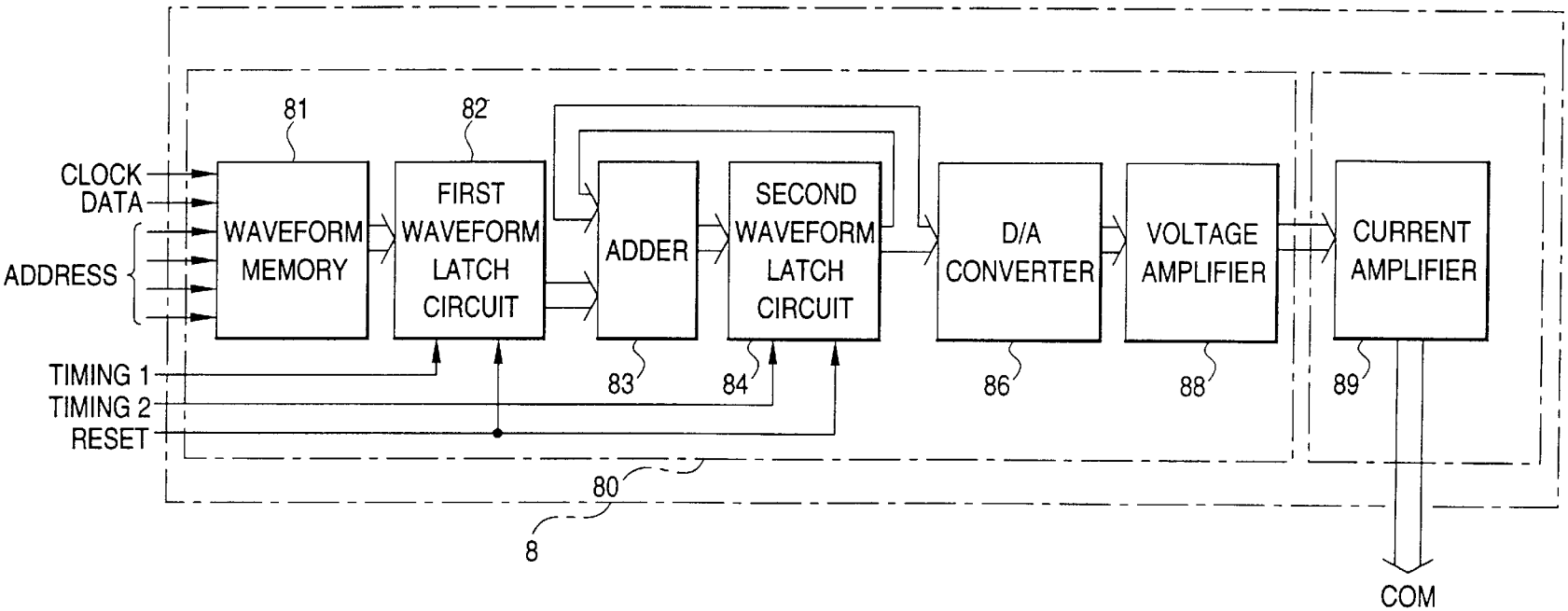
FIG. 4 is a block diagram to show the configuration of a drive signal generator.
Figure 5:
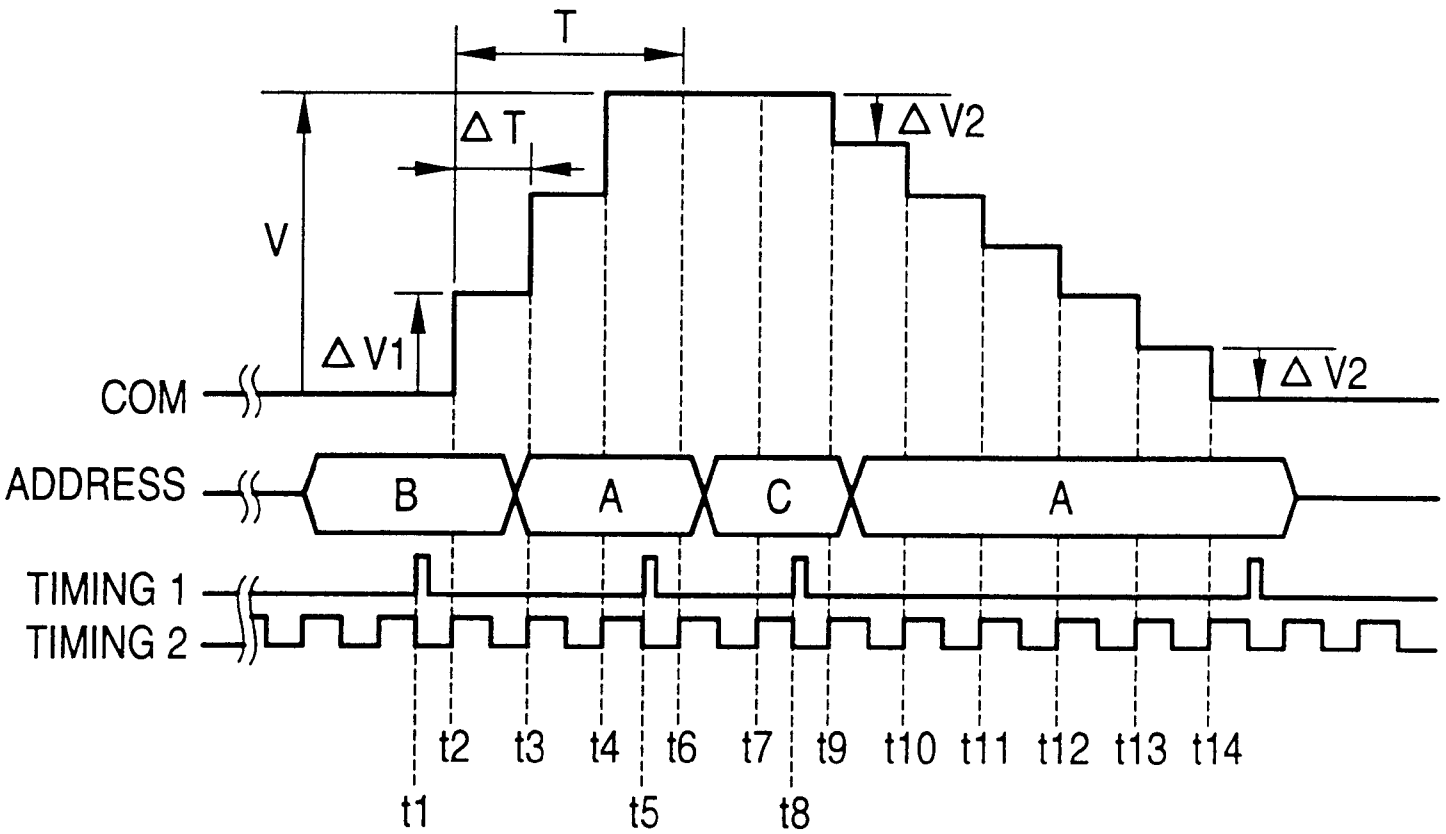
FIG. 5 is a timing chart to show a process of generating a waveform of a drive signal in the drive signal generator in FIG. 4.
Figure 6:
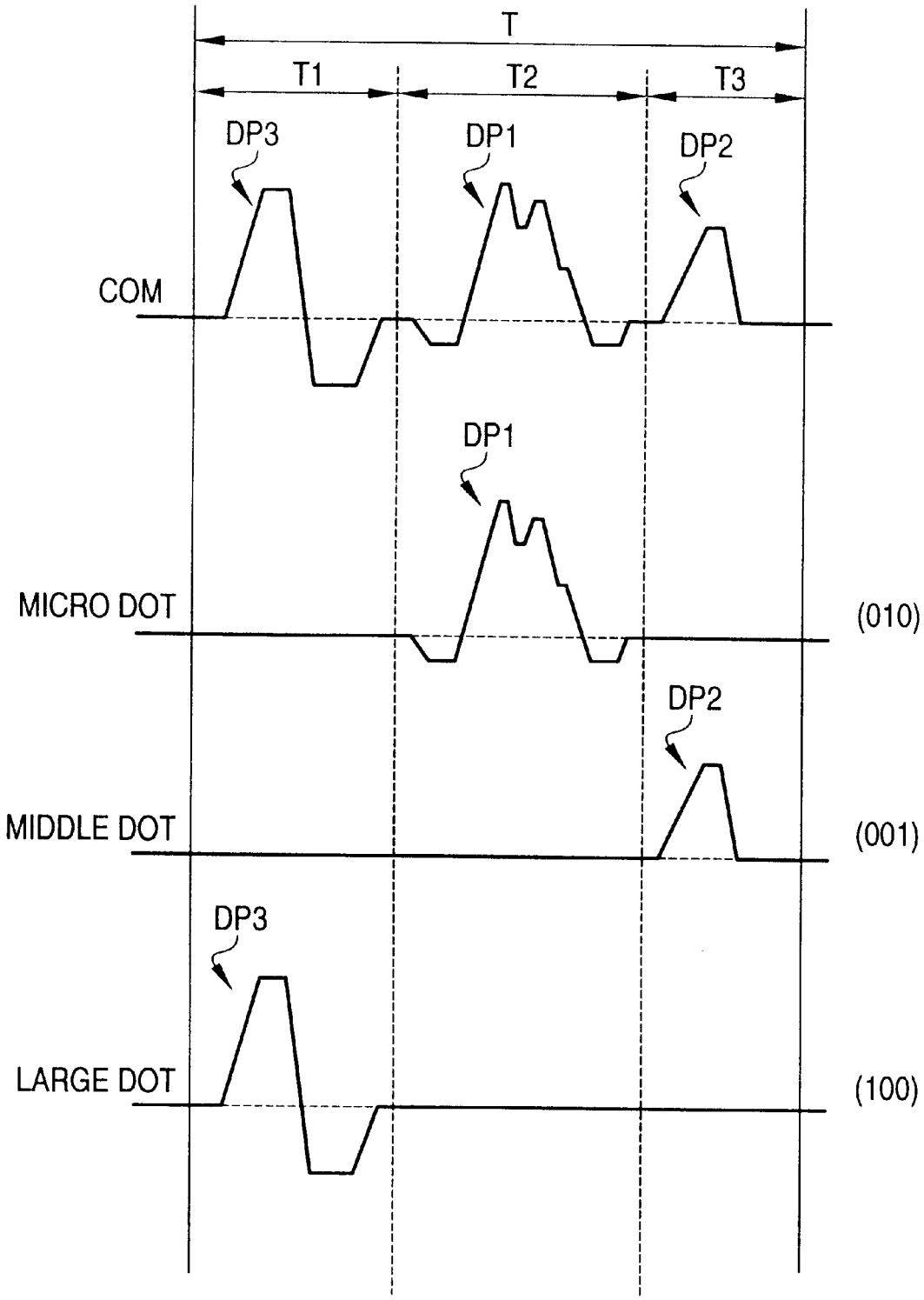
FIG. 6 is a drawing to describe drive signals and drive pulses.
Figure 7:
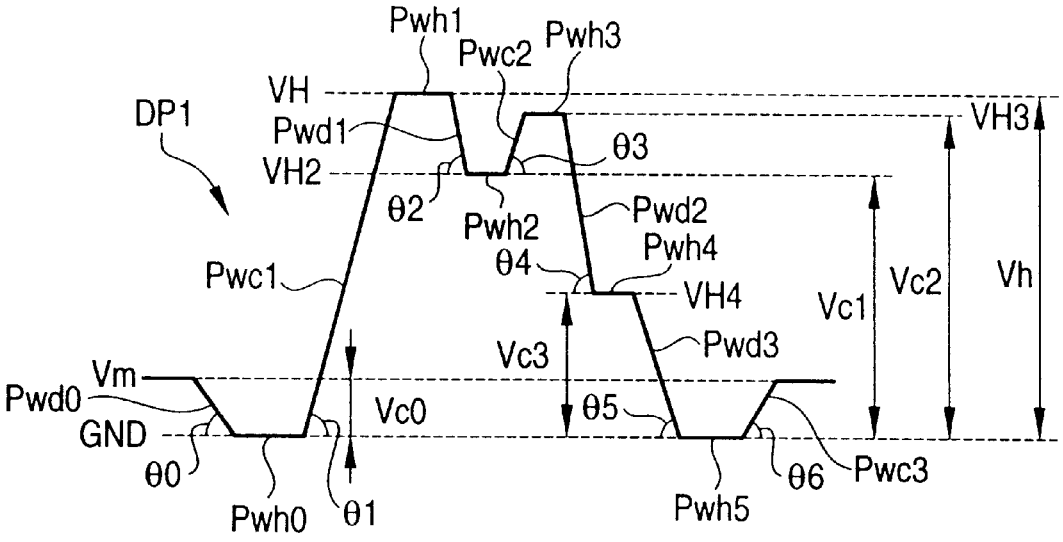
FIG. 7 is a time chart to show a microdot drive pulse.

Referring now to the accompanying drawings, there are shown embodiments of ink jet recording apparatus of the invention. FIGS. 1 to 7 show a first embodiment of an ink jet recording apparatus according to the invention. FIG. 1 is a perspective view of an ink jet printer of a representative ink jet recording apparatus, FIG. 2 is a sectional view to show a recording head, FIG. 3 is a block diagram to show the configuration of a control system of the recording head, FIG. 4 is a block diagram to show the configuration of a drive signal generator, FIG. 5 is a timing chart to show a process of generating a waveform which becomes a drive signal in the drive signal generator, FIG. 6 is a drawing to describe supply of a sequence of drive signals and drive pulses, and FIG. 7 is a time chart to show a microdot drive pulse.

In an ink jet printer 1, a carriage 2 is attached to a guide member 11 movably and is connected to a timing belt 14 placed on a drive pulley 12 and a driven pulley 13. The drive pulley 12 is joined to a rotation shaft of a pulse motor 15 and the carriage 2 is moved in the width direction of recording paper 3 (main scanning direction) as the pulse motor 15 is driven.

A recording head 4 is attached to a face of the carriage 2 opposed to the recording paper 3 (bottom face). The recording head 4 ejects ink supplied from an ink cartridge 5 as ink drops through nozzle orifices 51 (see FIG. 2).

Therefore, at the recording time, the printer 1 ejects ink drops from the recording head 4 in synchronization with main scanning of the carriage 2 and rotates a platen 16 in association with reciprocating of the carriage 2 for moving the recording paper 3 in the paper feed direction (subscanning direction). Resultantly, an image, text, etc., based on print data is recorded on the recording paper 3.

A home position is set within the move range of the carriage 2 and outside a record area, and a cleaning mechanism 17 for cleaning the recording head 4 and a capping mechanism 18 for capping the recording head 4 are placed side by side at the home position.

In addition, a printer controller 19 for controlling the operation of components making up the printer 1 is attached to a housing.

As shown in FIG. 2, the recording head 4 comprises a channel unit 7 joined to a tip face of a base 40. Ink in a pressure generating chamber 71 is pressurized by a piezoelectric actuator (a kind of pressure generating element) for jetting ink drops through nozzle orifices 51 made in a nozzle plate 50.

The base 40 is shaped like a box in which a housing chamber 43 is formed for housing a vibrator unit 46; for example, the base 40 is formed of a resin material. The housing chamber 43 is extended from the opening on the joint face side to the channel unit 7 to the opposite face.

The channel unit 7 comprises the nozzle plate 50 joined to one face of a channel formation plate 55 and a vibration plate 60 joined to an opposite face of the channel formation plate 55.

The channel formation plate 55 is formed of a silicon wafer, etc. It is etched, whereby it is partitioned in a predetermined pattern and a diaphragm is appropriately formed forming a plurality of pressure generating chambers 71 communicating with the nozzle orifices 51, a common ink reservoir 72, a plurality of ink supply channels 73 leading to the pressure generating chambers 71 from the common ink reservoir 72, and the like. The common ink reservoir 72 is formed with a connection port connected to an ink supply tube 48 and ink stored in the ink cartridge 5 is supplied through the connection port to the common ink reservoir 72.

A plurality of nozzle orifices 51 (for example, 96 openings) are made in the nozzle plate 50 like rows at the pitches corresponding to the dot formation density.

The vibration plate 60 adopts a double structure of depositing an elastic film 62 such as a PPS film on a stainless plate 61; the portion corresponding to each pressure generating chamber 71 is provided by etching the stainless plate like a ring and an island portion 70 is formed in the ring.

The vibrator unit 46 is made up of a piezoelectric actuator 6 (a kind of pressure generating element) and a fixation substrate 42. The piezoelectric actuator 6 is shaped like comb teeth provided by forming slit parts in a piezoelectric actuator plate comprising piezoelectric bodies and electrode layers deposited alternately, at a predetermined pitch corresponding to the pressure generating chambers 71. The fixation substrate 42 is fixedly secured to the base end part of the comb-teeth-like vibrator 6.

The tip of the piezoelectric actuator 6 is inserted into the housing chamber 43 of the base 40 at an attitude facing from an opening 41 and the fixation substrate 42 is fixedly secured to the inner wall of the housing chamber 43, whereby the vibrator unit 46 is housed. In this housing state, the tips of the piezoelectric actuator 6 are abutted against the corresponding island portions 70 of the vibration plate 60.

By giving a potential difference between opposed electrodes, each piezoelectric actuator 6 is expanded or contracted in the longitudinal direction thereof orthogonal to the laminated direction thereof, thereby displacing the elastic film 62 partitioning the pressure generating chambers 71. That is, in the recording head 4, the piezoelectric actuator 6 is expanded in the longitudinal direction thereof, whereby the island portion 70 is pressed against the nozzle plate 50 side and the elastic film 62 in the periphery of the island portion 70 becomes deformed, reducing the volume of the pressure generating chamber 71. If the piezoelectric actuator 6 is contracted in the longitudinal direction thereof, the elastic film 62 is displaced, enlarging the volume of the pressure generating chamber 71. As the pressure generating chamber 71 is enlarged and reduced, pressure fluctuation occurs in ink filled in the pressure generating chamber 71 and an ink drop is jetted through the nozzle orifice 51 of the channel unit 7.

Next, the electric configuration of the printer 1 will be discussed. As shown in FIG. 3, the printer controller 19 comprises an external interface 191, RAM (random access memory) 192 for temporarily storing various pieces of data, ROM (read-only memory) 193 for storing a control program, etc., a control section 194 consisting of a CPU (central processing unit), etc., an oscillator 195 for generating a clock signal, a drive signal generator 8 for generating a drive signal COM supplied to the recording head 4 and functioning as drive signal generating means of the invention, an internal interface 196 for supplying the drive signal and various signals of dot pattern data (bit map data) expanded based on print data and the like to the drive system of the recording head 4, etc., and the like.

The external interface 191 receives print data made up of character code, a graphic function, image data, etc., for example, from a host computer (not shown), etc. A busy signal (BUSY) and an acknowledge signal (ACK) are sent out through the external interface 191 to the host computer, etc.

The RAM 192, which is work memory, functions as a reception buffer RB, an intermediate buffer MB, an output buffer OB, etc. That is , the reception buffer RB temporarily stores the print data received through the external interface 191, the intermediate buffer MB stores intermediate code data provided by the control section 194, and the output buffer OB stores dot pattern data. The dot pattern data is print data provided by decoding gradation data.

The ROM 193 stores font data, graphic functions, etc., in addition to the control program (control routine) for performing various types of data processing.

The control section 194 performs various types of control based on the control program read from the ROM 193. It reads the print data in the reception buffer RB and stores the intermediate code data provided by converting the print data in the intermediate buffer MB. Also, the control section 194 analyzes the intermediate code data read from the intermediate buffer MB, references the font data, graphic function, etc., stored in the ROM 193, and expands the intermediate code data into dot pattern data. After performing necessary decoration processing, the control section 194 stores the dot pattern data in the output buffer OB.

If one line of the dot pattern data that can be recorded by one main scanning of the recording head 4 is provided, it is output from the output buffer OB through the internal interface 196 to the recording head 4 in sequence. When one line of the dot pattern data is output from the output buffer, the already expanded intermediate code data is erased from the intermediate buffer and the next intermediate code data is expanded.

An electric drive system 44 of the recording head 4 comprises shift register 94 (elements 94A to 94N), latch circuit 95 (elements 95A to 95N), level shifter 96 (elements 96A to 96N) of voltage amplifiers, switch 97 (elements 97A to 97N), and piezoelectric actuator 6 (elements 6A to 6N) connected in order, the elements being provided in a one-to-one correspondence with the nozzle orifices 51.

The ink drop jetting operation in the recording head 4 is controlled by the control section 194. In the jet control, first the most significant bit string data of print data (SI) is transmitted in series from the output buffer OB in synchronization with a clock signal (CK) of the oscillator 195 and is set in the shift register elements 94A to 94N in sequence.

If the print data for all nozzle orifices 51 is set in the shift register elements 94A to 94N, a latch signal (LAT) is output to the latch elements 95A to 95N at a predetermined timing for latching the print data set in the shift register elements 94A to 94N in the latch elements 95A to 95N.

The latched print data is supplied to the level shifter elements 96A to 96N. For example, if the print data is "1," each level shifter element 96A–96N is adapted to boost the print data to a voltage value at which the switch 97A–97N can be driven, for example, several tens of volts. The boosted print data is applied to the switch 97A–97N, which then enters a connection state as the print data is applied. For example, the print data is "0," the corresponding level shifter element 96A–96N does not boost the print data.

A drive signal COM from the drive signal generator 8 is applied to each switch 97A–97N and when the switch 97A–97N enters a connection state, the drive signal is supplied to the piezoelectric actuator 6A–6N connected to the switch 97A–97N.

If the drive signal is applied based on the most significant bit string data, subsequently the control section 194 transmits the second most significant bit string data in series and sets the data in the shift register 54A–54N. If the data is set in the shift register 94, the control section 194 gives a latch signal for latching the data, and supplies a drive signal to the piezoelectric actuator 6. After this, the same operation is repeated to the least significant bit string while the print data is shifted to the low-order bit string one bit string at a time.

Thus, in the described printer 1, whether or not the drive signal COM is to be supplied to the piezoelectric actuator 6 (element 6A–6N) of the recording head 4 is controlled based on the print data. While the print data is "1," the drive signal COM is supplied to the piezoelectric actuator 6; while the print data is "0," the drive signal COM is not supplied.

Next, the drive signal generator 8 will be discussed. As shown in the block diagram of FIG. 4, the drive signal generator 8 comprises a waveform generator 80 and a current amplifier 89; the waveform generator 80 generates a waveform signal used as the drive signal COM and outputs the signal to the current amplifier 89, which then amplifies the current of the signal and outputs the resultant signal as the drive signal COM.

The waveform generator 80 comprises waveform memory 81, a first waveform latch circuit 82, a second waveform latch circuit 84, an adder 83, a digital-analog converter 86 (D/A converter 86), and a voltage amplifier 88.

The waveform memory 81 functions as variation information storage means for storing different types of voltage variation data (variation information) output from the control section 194 separately corresponding to addresses. The first waveform latch circuit 82 functioning as variation information holding means of the invention is electrically connected to the waveform memory 81. The first waveform latch circuit 82 holds voltage variation data stored at a predetermined address of the waveform memory 81 in synchronization with a first timing signal. The adder 83 functions as addition means of the invention. Output of the first waveform latch circuit 82 and output of the second waveform latch circuit 84 are input to the adder 83 and the second waveform latch circuit 84 is electrically connected to output of the adder 83. The adder 83 adds the output signals together for providing addition voltage information.

The second waveform latch circuit 84 functions as output voltage information holding means of the invention and holds the data provided by the adder 83 (addition voltage information) as output voltage information for defining the waveform of the drive-signal COM in synchronization with a second timing signal. The D/A converter 86 is electrically connected to output of the second waveform latch circuit 84 and converts the data held in the second waveform latch circuit 84 into an analog signal. The voltage amplifier 88 is electrically connected to output of the D/A converter 86 and amplifies the analog signal provided by the D/A converter 86 to the voltage of the drive signal.

The current amplifier 89 is electrically connected to output of the voltage amplifier 88 and amplifies the electric current of the signal whose voltage is amplified by the voltage amplifier 88, then outputs the resultant signal as the drive signal COM.

In the described drive signal generator 8, a plurality of pieces of variation data indicating voltage change amounts are stored in storage locations of the waveform memory 81 separately before a drive signal is generated. For example, the control section 194 outputs variation data and address data corresponding to the variation data to the waveform memory 81. Then, the waveform memory 81 stores the variation data in the storage location specified by the address data. In the embodiment, the variation data is formed of data containing positive or negative (increase or decrease) information and the address data is formed of a 4-bit address signal.

When different types of variation data are thus stored in the waveform memory 81, it is made possible to generate a drive signal.

To generate a drive signal, while the variation data output from the first waveform latch circuit 82 to the adder 83 is changed, whenever a predetermined update timing comes, the data provided by the adder 83 is held in the second waveform latch circuit 84 as new output voltage information, whereby a drive signal of any desired form is generated.

In the embodiment, the variation data is set in the first waveform latch circuit 82 according to the 4-bit address signal input to the waveform memory 81 and the first timing signal input to the first waveform latch circuit 82. That is, the waveform memory 81 selects the target variation data based on the address signal. When the first timing signal is input, the first waveform latch circuit 82 reads the selected variation data from the waveform memory 81 and holds the data.

The variation data held in the first waveform latch circuit 82 is input to the adder 83. Since the output voltage information held in the second waveform latch circuit 84 is also input to the adder 83, the output data from the adder 83 becomes a voltage value resulting from adding the variation data held in the first waveform latch circuit 82 and the output voltage information held in the second waveform latch circuit 84. Since the variation data contains positive or negative information, if the variation data is a positive value, the output data from the adder 83 becomes a voltage value higher than the output voltage information (increases). On the other hand, if the variation data is a negative value, the output data from the adder 83 becomes a voltage value lower than the output voltage information (decreases). If the variation data is value "0," the output data from the adder 83 becomes the same voltage value as the output voltage information.

The output data from the adder 83 is input to and held in the second waveform latch circuit 84 in synchronization with the second timing signal. This means that the output voltage information from the second waveform latch circuit 84 is updated in synchronization with the second timing signal.

The drive signal generation operation will be discussed based on a specific example in FIG. 5. In this example, variation data of "0" is stored in address A of the waveform memory 81, variation data of +ΔV1 is stored in address B, and variation data of −ΔV2 is stored in address C.

If the first timing signal is input in a state in which the address signal indicating the address B is input to the waveform memory 81 (t1), the first waveform latch circuit 82 reads the variation data of +ΔV1 stored in address B from the waveform memory 81 and holds the data.

Then, the second waveform latch circuit 84 reads and holds the output data from the adder 83 at the update timing defined by the second timing signal, for example, on the rising edge of the second timing signal (t2). At the first timing after the first timing signal is supplied, ΔV1 resulting from adding ΔV1 to the GND potential of the current output voltage is held as a new output voltage.

Then, when the cycle ΔT has elapsed and the next update timing comes, the second waveform latch circuit 84 holds (2ΔV1) resulting from adding ΔV1 to the current output voltage, ΔV1, (ΔV1+ΔV1) as new output voltage data (t3).

When the cycle ΔV1 further has elapsed and the next update timing comes, the second waveform latch circuit 84 holds V (2ΔV1+ΔV1) as new output voltage data (t4).

If the variation data corresponding to the address B is held in the first waveform latch circuit 82, then the address signal contents are changed to the address A.

The address signal indicating the address A is referenced as another first timing signal is input (t5). That is, the first waveform latch circuit 82 reads and holds the variation data of the value "0" stored in the address A as the first timing signal is input.

When the variation data of the value "0" is held in the first waveform latch circuit 82, the output data from the adder 83 becomes the same voltage value as the output voltage from the second waveform latch circuit 84. Thus, while the variation data of the value "0" is held in the first waveform latch circuit 82, the output voltage from the second waveform latch circuit 84 maintains the preceding voltage value V if the update timing defined by the second timing signal comes (t6, t7).

As another first timing signal is input, the variation data of −ΔV2, the variation data corresponding to the address C, is held in the first waveform latch circuit 82 (t8).

When the variation data is held, each time the update timing comes, the output voltage from the second waveform latch circuit 84 drops ΔV2 at a time (t9–t14).

Thus, in the described drive signal generator 8, the waveform of the drive signal COM can be set to any desired form simply by outputting the parameters of the address and clock signals, etc., from the control section 194.

As to the drive signal COM, if the voltage value is increased, the piezoelectric actuator 6 of the recording head 4 is charged and is contracted in the longitudinal direction thereof, enlarging the volume of the pressure generating chamber 71. Conversely, if the voltage value is decreased, the piezoelectric actuator 6 is discharged and is expanded in the longitudinal direction thereof, reducing the volume of the pressure generating chamber 71.

Next, the drive signal COM generated by the drive signal generator 8 and supply of drive pulses making up the drive signal COM will be discussed.

The drive signal COM generated by the drive signal generator 8 is a signal comprising a plurality of types of drive pulses different in ink amount connected in a sequence. As shown in FIG. 6, the drive signal COM comprises a microdot drive pulse DP1 for jetting an extremely small amount of ink drop capable of forming a microdot through the nozzle orifice 51, a middle dot drive pulse DP2 for jetting a middle ink drop capable of forming a middle dot, and a large dot drive pulse DP3 for jetting a large ink drop capable of forming a large dot, and has the drive pulses connected in a sequence in the order of the large dot drive pulse DP3, the microdot drive pulse DP1, and the middle dot drive pulse DP2.

The print data (SI) is made up of three data bits corresponding to the drive pulses DP1 to DP3 and the drive pulses DP1 to DP3 are selectively supplied to the piezoelectric actuator 6 in response to the print data contents. That is, the most significant bit of the print data is used as the data bit for selecting of the large dot drive pulse DP3, the second most significant bit is used as the data bit for selecting the microdot drive pulse DP1, and the least significant bit is used as the data bit for selecting the middle dot drive pulse DP2.

To eject an extremely small ink drop capable of forming a microdot, the print data is set to (010) and the switch 97 is placed in a connection state during time T2, whereby the microdot drive pulse DP1 is selectively supplied from the drive signal COM to the piezoelectric actuator 6. Likewise, to eject a middle ink drop corresponding to a middle dot, the print data is set to (001) and the switch 97 is placed in a connection state during time T3, whereby the middle dot drive pulse DP2 is supplied from the drive signal COM. To eject a large ink drop corresponding to a large dot, the print data is set to (100) and the switch 97 is placed in a connection state during time T1, whereby the large dot drive pulse DP3 is supplied from the drive signal COM.

The control section 194, the shift register 94, the latch circuit 95, the level shifter 96, and the switch 97 for performing the operation function as drive pulse supply means for selectively supplying the necessary drive pulses DP1 to DP3 from the drive signal COM to the piezoelectric actuator 6.

The microdot drive pulse DP1 will be discussed in detail.

As shown in FIG. 7, the microdot drive pulse DP1 is a signal comprising a zeroth discharge element Pwd0 functioning as a previous contraction element of the invention, a zeroth hold element Pwh0, a first charge element Pwc1 functioning as a pull-in element of the invention, a first hold element Pwh1 functioning as a pull-in hold element of the invention, a first discharge element Pwd1 functioning as a first ejection element of the invention, a second hold element Pwh2 functioning as a ejection hold element of the invention, a second charge element Pwc2 functioning as a second ejection element of the invention, a third hold element Pwh3, a second discharge element Pwd2 functioning as a contraction element of the invention, a fourth hold element Pwh4, a third discharge element Pwd3, a fifth hold element Pwh5, and a third charge element Pwc3 functioning as a damping element of the invention; the elements are connected in order.

The zeroth discharge element Pwd0 drops potential from an intermediate potential (bias level) Vm to GND potential (zero potential, lowest potential) at comparatively gentle down gradient θ0. When the zeroth discharge element Pwd0 is supplied to the piezoelectric actuator 6, the pressure generating chamber 71 is contracted comparatively slowly from the reference volume defined by the intermediate potential Vm to the minimum volume defined by the GND potential.

The zeroth hold element Pwh0 maintains the zero potential, the immediately preceding potential, over a predetermined time.

The first charge element Pwc1 increases potential from the GND potential to first maximum potential VH at upward gradient θ1 to such an extent that an ink drop is not ejected. When the first charge element Pwc1 is supplied to the piezoelectric actuator 6, the pressure generating chamber 71 is expanded rapidly to the maximum volume defined by the first maximum potential VH. As the pressure generating chamber 71 is expanded, the pressure generating chamber 71 is decompressed and a meniscus (free surface of ink exposed at the nozzle orifice 51) is pulled largely into the pressure generating chamber 71.

In the embodiment, before the first charge element Pwc1 is supplied, the zeroth discharge element Pwd0 and the zeroth hold element Pwh0 are supplied, the pressure generating chamber 71 is contracted from the reference volume to the minimum volume, and after the expiration of the time defined by the zeroth hold element Pwh0, the pressure generating chamber 71 is expanded rapidly. Thus, the meniscus is once pushed out in the ink jetting direction, then is largely pulled into the pressure generating chamber 71 side.

In doing so, the behavior of the meniscus can be stabilized as compared with the case where the still meniscus is pulled into the pressure generating chamber 71 side abruptly. It is considered that the meniscus can be largely pulled into the pressure generating chamber 71 side matching the motion of the meniscus as the zeroth discharge element Pwd0 is supplied.

The above-mentioned intermediate potential Vm is a potential for defining the reference volume of the pressure generating chamber 71 and is determined based on the potential difference from drive voltage Vh, namely, the first maximum potential VH (maximum potential) to the GND potential (lowest potential). The intermediate potential Vm can be set in the range in which the potential difference Vc0 from the GND potential becomes 5% to 30% of the drive voltage Vh, and it is confirmed by experiment that it is optimum to set the potential difference Vc0 to 15% of the drive voltage Vh.

In the embodiment, the supply time (pulse width) of the first charge element Pwc1 is set to almost the same value as the natural period Tc of the pressure generating chamber for properly controlling the contraction of the pressure generating chamber 7. That is, the supply time of the first charge element Pwc1 is set to almost the same value as the natural period Tc, whereby the residual vibration of the pressure generating chamber 71 accompanying contraction of the piezoelectric actuator 6 can be prevented.

Thus, so-called crosstalk phenomenon that expansion or contraction of one pressure generating chamber 71 propagates to a neighboring pressure generating chamber 71 can be prevented.

The first hold element Pwh1 is an element for maintaining the first maximum potential VH, the immediately preceding potential, over a predetermined time; for example, it has a pulse width of 1 μsec.

The first discharge element Pwd1 is an element for dropping the potential from the first maximum potential VH to the second maximum potential VH2 at a steep down gradient θ2. When the first discharge element Pwd1 is supplied to the piezoelectric actuator 6, the pressure generating chamber 71 is a little contracted and the inside of the pressure generating chamber is a little pressurized, whereby the meniscus largely pulled in by the first discharge element Pwd1 is pushed back a little in the ink jetting direction.

The supply time of the first discharge element Pwd1 (pulse width) can be set in the range of 1 to 3 μsec, for example; in the embodiment, it is set to 1 μsec, because the ink drop jet speed can be made higher as the supply time of the first discharge element Pwd1 is shorter.

The second maximum potential VH2, the termination potential of the first discharge element Pwd1, is defined based on the drive voltage Vh. It is confirmed by experiment that the second maximum potential VH2 can be set in the range in which the potential difference Vc1 from the GND potential becomes 55% to 75% of the drive voltage Vh and that it is optimum to set the potential difference Vc1 to 70% of the drive voltage Vh. That is, if the second maximum potential VH2 is set to a high potential, the ink drop amount can be lessened, but if the second maximum potential VH2 is too high, the ink drop amount varies or the jetting path becomes unstable.

From the viewpoint of increasing the ink drop jetting speed, preferably the first discharge element Pwd1 is supplied following the first charge element Pwc1. In the embodiment, however, the first hold element Pwh1 is placed between the first charge element Pwc1 and the first discharge element Pwd1 and the termination of the first charge element Pwc1 and the start end of the first discharge element Pwd1 are connected at the same potential to protect the electric drive system 44 of the recording head 4. That is, if the first charge element Pwc1 and the first discharge element Pwd1 are supplied consecutively, the potential gradient is changed abruptly and a through current flows into the switch 97 (97A–97N), impairing the stability of the jetting operation. If the same potential is maintained for a given time by the first hold element Pwh1, the abrupt change of the potential gradient is eased and the trouble of allowing a through current to flow into the switch 97 can be prevented.

The second hold element Pwh2 is an element for maintaining the second maximum potential VH2, the immediately preceding potential, over a predetermined time and has a pulse width of 1 μsec, for example.

When the second hold element Pwh2 is supplied to the piezoelectric actuator 6, the operation of the first discharge element Pwd1 for contracting the pressure generating chamber 71 is stopped. At this time, it is considered that the center part of the meniscus is extended like a narrow pillar toward the ink jetting direction by an inertial force.

The second charge element Pwc2 is an element for increasing the potential from the second maximum potential VH2 to the third maximum potential VH3 at a steep upward gradient θ3. When the second charge element Pwc2 is supplied to the piezoelectric actuator 6, the pressure generating chamber 71 is again expanded. As the pressure generating chamber 71 is expanded, an extremely amount of ink drop (about 2 pL) is separated from the pillar part of the meniscus and is jetted.

The possible reason is that if the pressure generating chamber 71 is expanded while the pillar part of the meniscus is being extended in the ink jetting direction, the pressure generating chamber 71 is decompressed and the force of pulling back to the pressure generating chamber 71 side acts on the pillar part. That is, if the force of pulling back to the pressure generating chamber 71 side acts on the pillar part being extended in the jetting direction, the pillar part is broken on the tip side rather than an intermediate point in the related art by the force of pulling back.

The third maximum potential VH3, the termination potential of the second discharge element Pwd2, can be set in the range in which the potential difference Vc2 from the GND potential becomes 70% to 120% of the drive voltage Vh. In the embodiment, the third maximum potential VH3 is set to a potential higher than the second maximum potential VH2 and equal to or less than the first maximum potential VH. In other words, the jet expansion voltage from the start end potential of the second charge element Pwc2 to the termination potential is set equal to or less than the jet contraction voltage from the start end potential of the first discharge element Pwd1 to the termination potential. Specifically, it is set so that the potential difference Vc2 becomes 80% of the drive voltage Vh. The supply time of the second charge element Pwc2 (pulse width) can be set in the range of 1 to 3 μsec, for example; in the embodiment, it is set to 1 μsec.

If the supply time is set to 1 μsec, while the ink drop jet speed is held high, the ink amount and the ink drop path can be stabilized.

From the viewpoint of lessening the ink amount, preferably the second charge element Pwc2 is supplied following the first discharge element Pwd1. In the embodiment, however, the second hold element Pwh2 is placed between the first discharge element Pwd1 and the second charge element Pwc2 and the termination of the first discharge element Pwd1 and the start end of the second charge element Pwc2 are connected at the same potential.

The placement and connection are adopted to protect the electric drive system 44 of the recording head 4. That is, if the second charge element Pwc2 is supplied following the first discharge element Pwd1 consecutively, the potential gradient is changed abruptly and a through current flows into the switch 97 (97A–97N), impairing the stability of the jetting operation. If the potential is maintained for a given time by the second hold element Pwh2, the abrupt change of the potential gradient is eased and the trouble of allowing a through current to flow into the switch 97 can be prevented.

The third hold element Pwh3 is an element for maintaining the third maximum potential VH3, the immediately preceding potential, over a predetermined time and has a pulse width of 1 μsec, for example. It is an element for serving a similar function to that of the first hold element Pwh1 and provides the hold time for the following second discharge element Pwd2 to discharge stably.

The second discharge element Pwd2, which is a contraction part element of the invention, drops the potential from the third maximum potential VH3 to the contraction hold potential VH4 at a down gradient θ4 to such an extent that an ink drop is not jetted.

The fourth hold element Pwh4, which is a contraction hold element of the invention, connects the termination of the second discharge element Pwd2 (preceding contraction part element) and the start end of the third discharge element Pwd3 (following contraction part element) at the contraction hold potential VH4.

The third discharge element Pwd3, which is a contraction part element of the invention, drops the potential from the contraction hold potential VH4 to the GND potential at a down gradient θ5 to such an extent that an ink drop is not jetted.

In the embodiment, the down gradient θ5 of the third discharge element Pwd3, the potential gradient of the following contraction part element, is set to a gradient gentler than the down gradient θ4 of the second discharge element Pwd2, the potential gradient of the preceding contraction part element.

If the second discharge element Pwd2, the fourth hold element Pwh4, and the third discharge element Pwd3 are supplied to the piezoelectric actuator 6 in order, the pressure generating chamber 71 expanded as the third hold element Pwh3 is supplied is contracted to the minimum volume defined based on the GND potential. In the embodiment, the fourth hold element Pwh4 at a constant potential is placed between the second discharge element Pwd2 and the third discharge element Pwd3, so that contraction of the pressure generating chamber 71 stops only for an extremely short time between the operation of the second discharge element Pwd2 for contracting the pressure generating chamber 71 and the operation of the third discharge element Pwd3 for contracting the pressure generating chamber 71.

If the contraction is thus temporarily stopped during the operation of contracting the pressure generating chamber 71, jetting an ink drop can be stabilized as compared with the case where the pressure generating chamber 71 is contracted consecutively from the volume defined based on the third maximum potential VH3 to the minimum volume, For example, the ink drop amount difference and the jet speed difference can be lessened between the case where ink drops are jetted through all nozzle orifices 51 and the case where ink drops are jetted through several nozzle orifices 51.

The possible reason is that pressure fluctuation in the pressure generating chamber 71 at the contraction time becomes small by contracting the pressure generating chamber 71 gradually. Further, it is considered that pressure fluctuation in the pressure generating chamber 71 at the contraction time can be made furthermore small by setting the down gradient θ5 of the third discharge element Pwd3 to a gradient gentler than the down gradient θ4 of the second discharge element Pwd2.

It is confirmed by experiment that ink drops can be jetted stably by shortening the supply time of the fourth hold element Pwh4 as much as possible. Then, in the embodiment, the supply time is set to a pulse width of 1 μsec, which is the minimum time that can be controlled by the electric drive system 44.

The contraction hold potential VH4 is defined based on the drive voltage Vh. It can be set in the range in which the potential difference Vc3 from the GND potential becomes 20% to 50% of the drive voltage Vh, and in the embodiment it is confirmed by experiment that it is optimum to set the potential difference Vc3 to 40% of the drive voltage Vh.

The supply time of the second discharge element Pwd2 (pulse width) can be set in the range of 2 to 5 μsec; in the embodiment, it is set to 3.5 μsec from balance with the contraction hold potential VH4. Likewise, the supply time of the third discharge element Pwd3 (pulse width) can be set in the range of 5 to 8 μsec; in the embodiment, it is set to 6.5 μsec.

The fifth hold element Pwh5 holds the immediately preceding GND potential intact for a predetermined time and the third charge element Pwc3 increases the potential from the GND potential to the intermediate potential Vm at an upward gradient θ6.

The third charge element Pwc3 expands and restores the pressure generating chamber 71 from the minimum volume defined based on the GND potential to the reference volume defined based on the intermediate potential Vm, whereby vibration of the meniscus is damped in a short time. The supply time of the third charge element Pwc3 in the embodiment is set fitting the natural period Ta of the piezoelectric actuator 6, so that the residual vibration of the piezoelectric actuator 6 accompanying contraction of the piezoelectric actuator 6 can be minimized and the pressure generating chamber 71 can be expanded smoothly.

The fifth hold element Pwh5 defines the supply start timing of the third charge element Pwc3. That is, the supply time of the fifth hold element Pwh5 is set, whereby expansion of the pressure generating chamber 71 performed by the third charge element Pwc3 can be started at the optimum timing.

As described above, if the microdot drive pulse DP1 is supplied to the piezoelectric actuator 6, the pressure generating chamber 71 is rapidly decompressed by the first charge element Pwc1 for largely pulling the meniscus into the pressure generating chamber 71 and the pressure generating chamber 71 is a little pressurized by the first discharge element Pwd1 just after the decompression terminates and the pressure generating chamber 71 is again decompressed by the second charge element Pwc2 just after the pressurization terminates.

In the operation sequence, the force of pulling into the pressure generating chamber 71 side produced as the pressure generating chamber 71 is decompressed by the second charge element Pwc2 acts on the ink pillar produced as the pressure generating chamber 71 is pressurized by the first discharge element Pwd1 (pillar part formed at the center of the meniscus), thus only the tip part of the ink pillar is separated from the ink pillar and is jetted as an ink drop.

Thus, an ink drop of a smaller ink amount than that in the related art, for example, an ink drop of 2 pL can be jetted. Further, in the jet control, only the tip part of the ink pillar grown narrowly can be jetted as an ink drop, so that tailing (satellite) of the jetted ink drop lessens, whereby a satellite dot (mist) can be prevented from degrading the image quality or making the recorder dirty.

Figure 8:
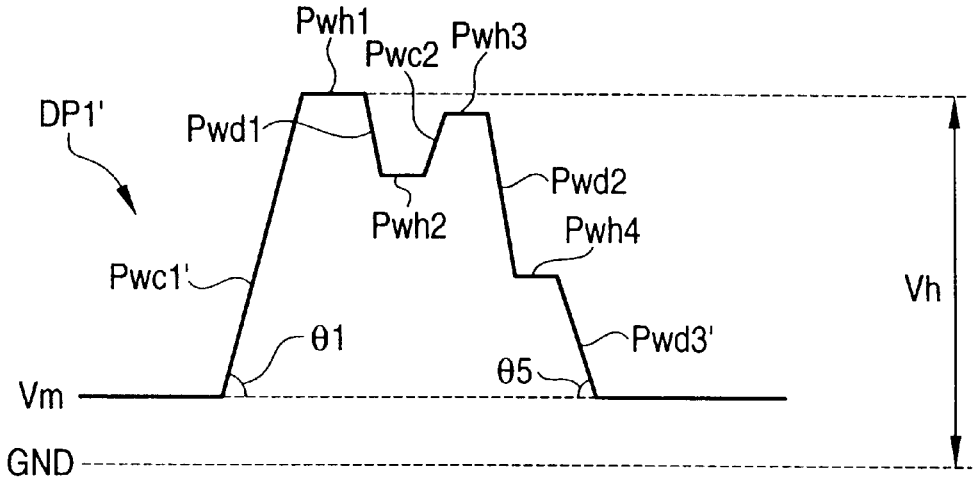
FIG. 8 is a time chart to show a microdot drive pulse according to a second embodiment of the invention.

By the way, the microdot drive pulse according to the invention is not limited to the above-described form. FIG. 8 shows a second embodiment of the invention and is a time chart to show a microdot drive pulse of another form.

The second embodiment is the same as the first embodiment in recorder configuration, etc., and the waveform of a microdot drive pulse DP1' is changed by changing a parameter given to a drive signal generator 8.

The microdot drive pulse DP1' is a signal comprising a first charge element Pwc1' functioning as a pull-in element of the invention, a first hold element Pwh1 functioning as a pull-in hold element of the invention, a first discharge element Pwd1 functioning as a first ejection element of the invention, a second hold element Pwh2 functioning as a ejection hold element of the invention, a second charge element Pwc2 functioning as a second ejection element of the invention, a third hold element Pwh3, a second discharge element Pwd2 functioning as a contraction element of the invention, a fourth hold element Pwh4, and a third discharge element Pwd3'; the elements are connected in order.

The differences between the microdot drive pulse DP1' and the microdot drive pulse DP1 of the first embodiment are that the microdot drive pulse DP1' does not include the zeroth discharge element Pwd0, the zeroth hold element Pwh0, the fifth hold element Pwh5, or the third charge element Pwc3 and that the start end potential of the first charge element Pwc1' and the termination potential of the third discharge element Pwd3' become intermediate potential Vm.

If the microdot drive pulse DP1' is supplied to a piezoelectric actuator 6, like the microdot drive pulse DP1, a pressure generating chamber 71 is rapidly decompressed by the first charge element Pwc1' for largely pulling a meniscus into the pressure generating chamber 71 and the pressure generating chamber 71 is a little pressurized by the first discharge element Pwd1 just after the decompression terminates and the pressure generating chamber 71 is again decompressed by the second charge element Pwc2 just after the pressurization terminates, so that an extremely small amount of ink drop can be jetted. In the microdot drive pulse DP1', the necessary pulse width (time from the start end of the first charge element Pwc1' to the termination of the third discharge element Pwd3') can be shorter than that of the drive pulse DP1, thus the drive pulse DP1' is suitable for a printer for recording at high speed.

Figure 9:
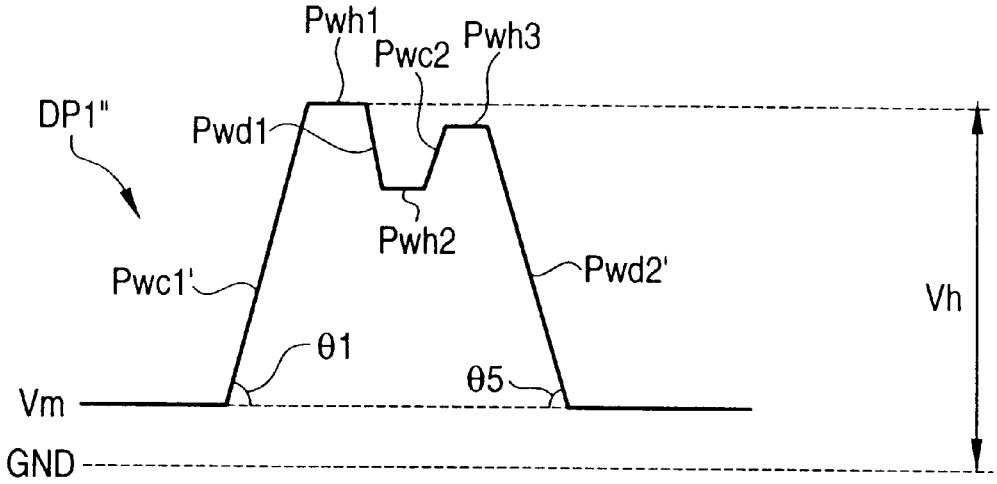
FIG. 9 is a time chart to show a microdot drive pulse according to a third embodiment of the invention.

FIG. 9 shows a third embodiment of the invention and is a time chart to show a microdot drive pulse of still another form. The third embodiment is also the same as the first embodiment in recorder configuration, etc., and the waveform of a microdot drive pulse DP1" is changed by changing a parameter given to a drive signal generator 8.

The microdot drive pulse DP1" is a signal comprising a first charge element Pwc1' functioning as a pull-in element of the invention, a first hold element Pwh1 functioning as a pull-in hold element of the invention, a first discharge element Pwd1 functioning as a first ejection element of the invention, a second hold element Pwh2 functioning as a ejection hold element of the invention, a second charge element Pwc2 functioning as a second ejection element of the invention, a third hold element Pwh3, and a second discharge element Pwd2' functioning as a contraction element of the invention; the elements are connected in order.

The differences between the microdot drive pulse DP1" and the microdot drive pulse DP1' of the second embodiment are that the fourth hold element Pwh4 and the third discharge element Pwd3' are deleted and that the termination potential of the second discharge element Pwd2' is adopted as intermediate potential Vm.

If the microdot drive pulse DP1" is supplied to a piezoelectric actuator 6, like the microdot drive pulse DP1, a pressure generating chamber 71 is rapidly decompressed by the first charge element Pwc1' for largely pulling a meniscus into the pressure generating chamber 71 and the pressure generating chamber 71 is a little pressurized by the first discharge element Pwd1 just after the decompression terminates and the pressure generating chamber 71 is again decompressed by the second charge element Pwc2 just after the pressurization terminates, so that an extremely small amount of ink drop can be jetted. Also in the microdot drive pulse DP1", the necessary pulse width (time from the start end of the first charge element Pwc1' to the termination of the second discharge element Pwd2') can be shorter than that of the drive pulse DP1, thus the drive pulse DP1" is also suitable for a printer for recording at high speed.

Figure 10:
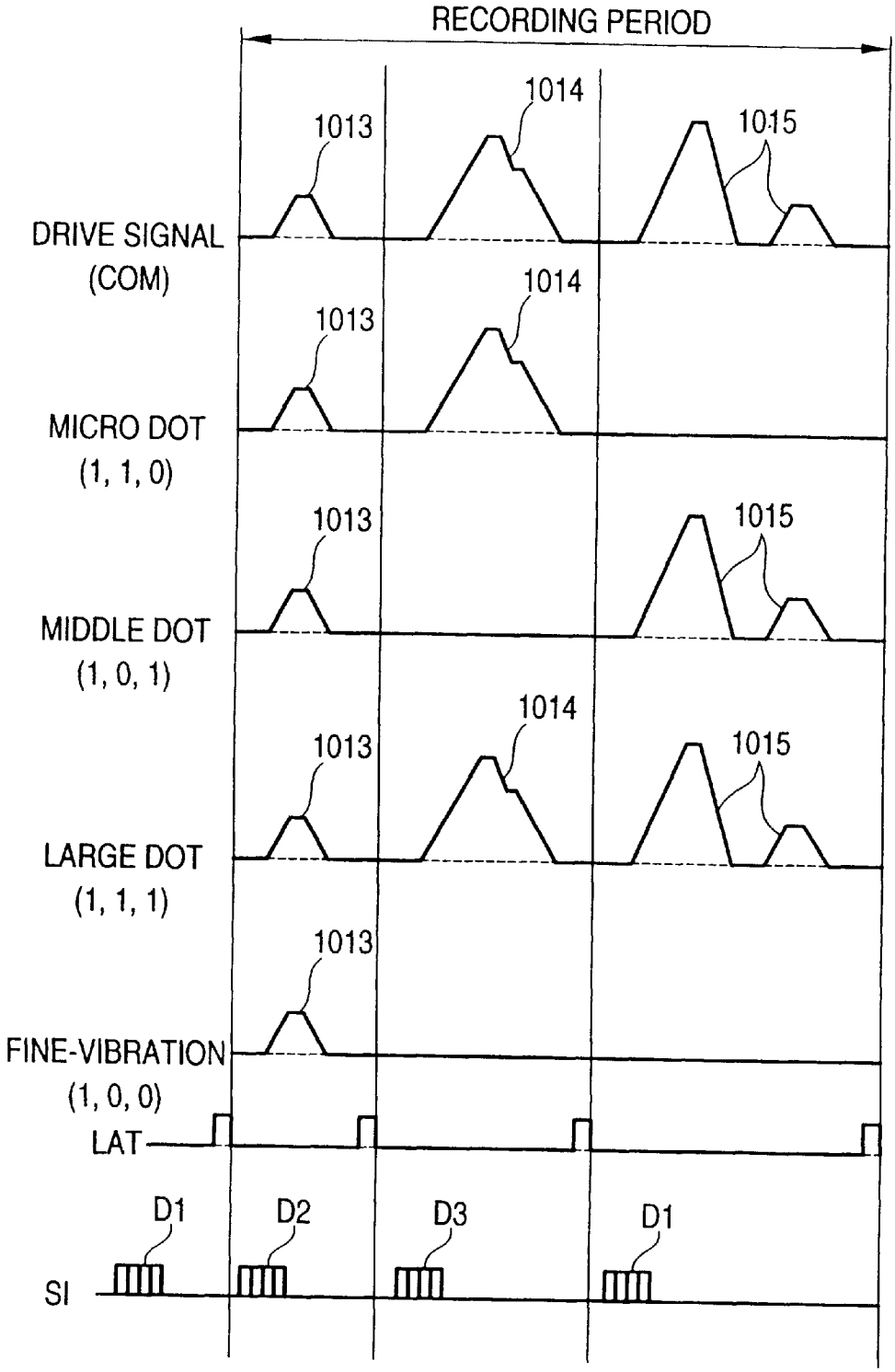
FIG. 10 is a diagram to describe drive signals and drive pulses according to a fourth embodiment of the present invention.

FIG. 10 shows a fourth embodiment of the present invention which adopts a drive signal COM different from the drive signal shown in FIG. 6. In this embodiment, a print data SI comprises 3-bit data D1, D2 and D3. A fine-vibration drive pulse 1013, a microdot drive pulse 1014 and a middle dot drive pulse 1015 are associated with the print data D1, D2 and D3, respectively. The respective waveforms are selectively supplied to the piezoelectric actuator 6 in response to the print data contents in order to eject a plurality kinds of ink drops different in amount from the nozzle orifice 51.

For example, setting D1=1, D2=1, D3=0 as the print data, the fine-vibration drive pulse 1013 and the microdot drive pulse 1014 are supplied to the piezoelectric actuator 6, and thereby an ink drop for forming a microdot is ejected from the nozzle orifice 51. Setting D1=1, D2=0, D3=1 as the print data, the fine-vibration drive pulse 1013 and the middle dot drive pulse 1015 are supplied to the piezoelectric actuator 6, and thereby an ink drop for forming a middle dot is ejected from the nozzle orifice 51. Setting D1=1, D2=1, D3=1 as the print data, the fine-vibration drive pulse 1013, the microdot drive pulse 1014 and the middle dot drive pulse 1015 are supplied to the piezoelectric actuator 6, and thereby an ink drop for forming a microdot an ink drop for forming a middle dot is ejected from the nozzle orifice 51 to form a large dot. Setting D1=1, D2=0, D3=0 as the print data, the fine-vibration drive pulse 1013 is supplied to the piezoelectric actuator 6, and thereby a meniscus in the nozzle orifice 51, namely, a free surface of ink exposed to the nozzle orifice 51 is vibrated finely. Accordingly, the ink in the nozzle orifice 51 is agitated to prevent ink viscosity from increasing.

In this embodiment, 4 ng of an ink drop for forming a microdot and 11 ng of an ink drop for forming a middle dot are ejected from the nozzle orifice 51 by supplying the microdot drive pulse 1014 and the middle dot drive pulse 1015 to the piezoelectric actuator 6, respectively. As described above, a large dot can be formed by supplying the microdot drive pulse 1014 and the middle dot drive pulse 1015 to the piezoelectric actuator 6 successively.

All the drive pulses for ejecting ink drops are preceded by the fine-vibration drive pulse 1013 to contract/expand finely the piezoelectric actuator 6 to thereby reduce/enlarge the volume of the pressure generating chamber 71 finely. According to the fine volume variation of the pressure generating chamber 71, the meniscus of ink is finely vibrated to such an extent that an ink drop is not ejected in order to prevent the ink viscosity from increasing.

Figure 11:
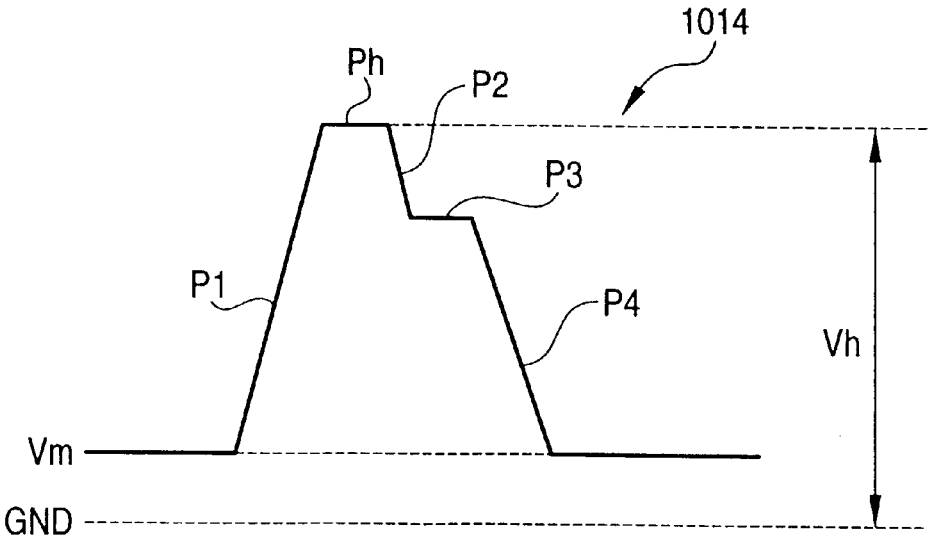
FIG. 11 is a time chart to show a microdot drive pulse according to the fourth embodiment of the invention.

FIG. 11 shows a microdot drive pulse 1014 of the present embodiment. The microdot drive pulse 1014 comprises: a pull-in element P1 for charging a piezoelectric actuator of a recording head to pull-in ink to the pressure generating chamber in the part of an upward gradient of an upwardly convex waveform; and a first contraction element P2 and a second contraction element P4 for discharging the piezoelectric element to contract the pressure generating chamber in the parts of down gradients. The termination of the pull-in element P1 and the first contraction element P2 are connected by a first hold element Ph. The termination of the first contraction element P2 and the second contraction element P4 are connected by a second hold element P3 at a constant potential.

According to the microdot drive pulse 1014 shown in FIG. 11, between the first contraction element P2 and the second contraction element P4 for expanding the piezoelectric actuator 6, there is supplied the second hold element P3 for temporarily stopping the expansion. When the second hold element P3 for is applied while an ink pillar is being formed by the application of the first contraction element P2, an extremely small ink drop is separated from the pillar and jetted from the nozzle orifice 51. When the ink drop is jetted, a meniscus is largely pulled in toward the pressure generating chamber 71 while the potential of the drive pulse is maintained for a predetermined time period by the second hold element P3. Then the potential is fell toward the lower limit potential by the second contraction element P4 at a proper timing. The second contraction element P4 pushes out the meniscus to the nozzle orifice.

Therefore, the pulse width of the second hold element P3 is set appropriately, whereby the force bringing the meniscus back to the pressure generating chamber and the force contracting the pressure generating chamber offset each other, and the amount of pulling in the meniscus after the ink drop is jetted decreases, whereby the residual vibration after the ink drop is jetted is decreased.

The time interval between the instant at which the ink drop is jetted and the instant at which the maximum amount of pulling in the meniscus after the ink drop is jetted is reached becomes about 3.5 $\mu$sec to 5.5 $\mu$sec, for example. Therefore, the appropriate pulse width of the holding element P3 is within the range of 0.8 $\mu$sec to 1.2 $\mu$sec according to the experiment carried out by the inventor.

Further, the gradient of the first contraction element P2 is adjusted and the signal sum of the first contraction element P2 and the second hold element P3 is adjusted to a half a natural period of the piezoelectric actuator, whereby the residual vibration of the piezoelectric actuator can be decreased.

The gradient of the second contraction element P4 for decreasing the residual vibration of ink in the pressure generating chamber after the ink drop is jetted is set so that the time from the start of the first contraction element P2 to the termination of the second contraction element P4 becomes almost equal to natural period Tc of the pressure generating chamber. That is, the following relationship is satisfied.

(pulse width of the second contraction element P4)=

(natural period Tc of pressure generating chamber)−

(pulse width of first contraction element P2)−

(pulse width of second hold element P3)

The sum of the pulse widths of the first contraction element P2, the second hold element P3 and the second contraction element P4 is set to the natural period Tc of the pressure generating chamber, whereby the residual vibration of the pressure generating chamber can be attenuated.

According to the experiment carried out by the inventor, the potential of the second hold element P3 is set to 45% to 70% of the potential of the pulling element P1, whereby appropriate ink speed and stability can be provided in the drive waveform with ink drop minimized. Since the time from the start of the first contraction element P2 to the termination of the second contraction element P4 is set so as to become almost equal to the natural period Tc of the pressure generating chamber, for example, if the potential of the second hold element P3 is low, the gradient of the first contraction element P2 becomes large and the gradient of the second contraction element P4 becomes small, thus sufficient damping action cannot be attained, resulting in instability of ink ejection. On the other hand, if the potential of the second hold element P3 is high, the gradient of the first contraction element P2 becomes small and the gradient of the second contraction element P4 becomes large, thus proper ink jetting speed cannot be attained. In the above discussion the pulse width (duration) of the second hold element P3 is made constant.

The drive signal COM including the aforementioned microdot drive pulse is limited to the example shown in FIG. 10. For example, the drive signal COM shown in FIG. 6 may include the microdot drive pulse 1014 shown in FIG. 11. Similarly, the drive signal shown in FIG. 10 may include the microdot drive pulses shown in FIGS. 7 to 9.

In the embodiments, the piezoelectric actuator 6 for expanding the pressure generating chamber 71 by charging and contracting the pressure generating chamber 71 by discharging is shown as an example; however, if a piezoelectric actuator for contracting the pressure generating chamber 71 by charging and expanding the pressure generating chamber 71 by discharging is used, a similar configuration can also be provided.

The pressure generating chamber for changing the volume of the pressure generating chamber 71 is not limited to a piezoelectric actuator. For example, it may be a magnetostrictor.

As described throughout the specification, the invention provides the following advantages:

After the pressure generating chamber is expanded and the meniscus is pulled in, the pressure generating chamber is a little pressurized and after the pressurization, the pressure generating chamber is again expanded, thereby jetting an ink drop. Thus, an extremely small amount of ink drop can be jetted through a nozzle orifice having a large bore size, whereby the formed dot size can be made smaller than that in the related art and the image quality can be improved.

In jet drive using the drive signal, tailing (satellite) is hard to appear in the jetted ink drop, so that a satellite dot (mist) can also be prevented from making the peripheral portion of the recorder dirty.

Further, the extremely small amount of ink drop can be ejected also by stopping the contraction process of the piezoelectric actuator temporarily to attenuate the residual vibration of the meniscus after the ejection of ink drop.

What is claimed is:

1. An ink jet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to deform the same in accordance with the potential of the signal, the drive signal including:

a pull-in element for varying the potential of the drive signal such that the pressure generating chamber is expanded to pull in a meniscus of the ink in the nozzle thereto;

a first ejection element for varying the potential of the drive signal such that the expanded pressure generating chamber is partly contracted; and a second ejection element for varying the potential of the drive signal such that the contracted pressure generating chamber is expanded again to eject the ink drop from the nozzle.

2. The ink jet recording apparatus as set forth in claim 1, wherein the drive signal includes:

a pull-in hold element connecting an end potential of the pull-in element and a start potential of the first ejection element at the same potential; and an ejection hold element connecting an end potential of the first ejection element and a start potential of the second ejection element at the same potential.

3. The ink jet recording apparatus as set forth in claim 1, wherein the potential difference of the second ejection element is equal to the potential difference of the first ejection element or less.

4. The ink jet recording apparatus as set forth in claim 1, wherein the potential of the second ejection element at an end potential thereof is the potential of the first ejection element at a start potential thereof or less, and is higher than the end potential of the first ejection element at an end potential thereof.

5. The inkjet recording apparatus as set forth in claim 1, wherein a duration of the pull-in element corresponds to a natural period of the pressure generating chamber.

6. The ink jet recording apparatus as set forth in claim 1, wherein the drive signal includes a contraction element after the second ejection element for varying the potential such that the pressure generating chamber expanded by the second ejection element of the drive signal is contracted such an extent that an ink drop is not ejected from the nozzle.

7. The ink jet recording apparatus as set forth in claim 6, wherein the contraction element includes at least two contraction elements.

8. The ink jet recording apparatus as set forth in claim 7, wherein the contraction element includes at least one contraction hold element connecting the preceding contraction element and the following contraction element at the same potential.

9. The ink jet recording apparatus as set forth in claim 8, wherein the potential gradient of the following contraction element is equal to or less than the potential gradient of the preceding contraction element.

10. The ink jet recording apparatus as set forth in claim 6, wherein the drive signal includes a damping element for varying the potential such that the pressure generating chamber contracted by the contraction element is restored to an original volume thereof in order to stabilize the motion of the meniscus.

11. The ink jet recording apparatus as set forth in claim 1, wherein the drive signal includes a previous contraction element for varying the potential such that the pressure generating chamber is once contracted before the application of the pull-in element.

12. The inkjet recording apparatus as set forth in claim 1, wherein the drive signal generator includes:

an output voltage information storage for storing a potential value of the drive signal;

a variation information storage for storing a variation amount of the potential of the drive signal; and a calculator for calculating a potential value based on at least the potential value stored in the output voltage information storage and the variation amount stored in the variation information storage, and wherein the calculation result is loaded in the output voltage information storage every predetermined period while changing the variation amount stored in the variation amount storage to generate a drive signal programmably.

13. The ink jet recording apparatus as set forth in claim 1, wherein the drive signal includes a second drive pulse for ejecting an ink drop heavier than the ink drop ejected by a first drive pulse defined by the pull-in element, the first ejection element and the second ejection element.

14. The ink jet recording apparatus as set forth in claim 13, wherein the drive signal includes a third drive pulse for ejecting an ink drop heavier than the ink drop ejected by the application of the second drive pulse.

15. The ink jet recording apparatus as set forth in claim 14, wherein the third drive pulse, the first drive pulse and the second drive pulse a re arranged in order in the drive signal.

16. An inkjet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to form the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle; and a second contraction element for varying the potential of the drive signal such that the pressure generating chamber is contracted again to stabilize vibration of the meniscus of the ink, wherein the potential gradient of the first contraction element is steeper than the potential gradient of the second contraction element, and wherein a time period from a start end of the first contraction element to an end potential of the hold element is equal to a half of a natural period of the piezoelectric actuator.

17. An inkjet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to form the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle; and a second contraction element for varying the potential of the drive signal such that the pressure generating chamber is contracted again to stabilize vibration of the meniscus of the ink, wherein the potential gradient of the first contraction element is steeper than the potential gradient of the second contraction element, and wherein a time period from a start potential of the first contraction element to an end potential of the second contraction element is equal to a natural period of the pressure generating chamber.

18. An inkjet recording apparatus comprising: a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to form the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle; and a second contraction element for varying the potential of the drive signal such that the pressure generating chamber is contracted again to stabilize vibration of the meniscus of the ink, wherein the potential gradient of the first contraction element is steeper than the potential gradient of the second contraction element, and wherein the sum of the durations of the first contraction element, the hold element, and the second contraction element is the natural period Tc of the pressure generating chamber.

19. A method of driving a recording head including a nozzle communicating with a pressure generating chamber, from which an ink drop is ejected due to volume variation of the pressure genetating chamber, comprising the steps of:

expanding the pressure generating chamber to pull in a meniscus of the ink in the nozzle thereto;

contracting partly the expanded pressure generating chamber; and expanding again the contracted pressure generating chamber to eject the ink drop from the nozzle.

20. The method of driving a recording head as set forth in claim 19, further comprising, after the first said expanding step, and before the contracting step, a step of retaining the expanded state of the pressure generating chamber.

21. The method of driving a recording head as set forth in claim 20, further comprising, after the contracting step, a step of retaining the partly contracted state of the expanded pressure generating chamber.

22. The method of driving a recording head as set forth in claim 19, wherein a time period required for completing the first said expanding step is set to be substantially identical to the natural period of the pressure generating chamber.

23. The method of driving a recording head as set forth in claim 19, further comprising, after the second said expanding step, a second contracting step wherein the pressure generating chamber is contracted without ejecting an ink drop from the nozzle.

24. The method of driving a recording head as set forth in claim 23, wherein the second contracting step is performed in two distinct contractions.

25. The method of driving a recording head as set forth in claim 24, further comprising a holding step in between the two distinct contractions.

26. The method of driving a recording head as set forth in claim 25, wherein a potential gradient used in the second of the two distinct contractions is less than or equal to a potential gradient of the first one of the two distinct contractions.

27. The method of driving a recording head as set forth in claim 19, further comprising a preliminary step of contracting the pressure generating chamber prior to the first said expanding step.

28. The method of driving a recording head as set forth in claim 23, further comprising, after the second contracting step, a step of restoring the state of the pressure generating chamber to an original volume whereby the motion of the meniscus is stabilized.

29. A method of driving a recording head including a nozzle communicating with a pressure generating chamber, from which an ink drop is ejected due to volume variation of the pressure generating chamber, comprising the steps of:

expanding the pressure generating chamber to pull in a meniscus of the ink in the nozzle thereto;

contracting partly the expanded pressure generating chamber during a first duration of time defining a first contraction;

retaining the contracted state of the pressure generating chamber to eject the ink drop from the nozzle during a second duration of time defining a hold; and contracting again the pressure generating chamber, during a third duration of time defining a second contraction, to stabilize vibration of the meniscus of the ink;

wherein the sum of the durations of the first contraction, the hold, and the second contraction is the natural period Tc of the pressure generating chamber.

30. An inkjet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to form the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle; and a second contraction element for varying the potential of the drive signal such that the pressure generating chamber is contracted again to stabilize vibration of the meniscus of the ink, wherein the drive signal includes a second drive pulse for ejecting an ink drop heavier than the ink drop ejected by a first drive pulse defined by the pull-in element, the first contraction element, the hold element and the second contraction element, and wherein a time period from a start end of the first contraction element to an end potential of the hold element is equal to a half of a natural period of the piezoelectric actuator.

31. An inkjet recording apparatus comprising:

a recording head including a piezoelectric actuator for varying the volume of a pressure generating chamber by the deformation thereof to eject an ink drop from a nozzle communicating with the pressure generating chamber; and a drive signal generator for supplying a drive signal supplied to the piezoelectric actuator to form the same in accordance with the potential of the signal, the drive signal including:

a pull-in element for varying the potential of the drive signal such that the pressure generating chamber is expanded to pull in a meniscus of the ink in the nozzle thereto;

a first contraction element for varying the potential of the drive signal such that the expanded pressure generating chamber is partly contracted;

a hold element for holding the potential of the drive signal such that the contracted state of the pressure generating chamber is retained to eject the ink drop from the nozzle; and a second contraction element for varying the potential of the drive signal such that the pressure generating chamber is contracted again to stabilize vibration of the meniscus of the ink, wherein the drive signal includes a second drive pulse for ejecting an ink drop heavier than the ink drop ejected by a first drive pulse defined by the pull-in element, the first contraction element, the hold element and the second contraction element, and wherein a time period from a start potential of the first contraction element to an end potential of the second contraction element is equal to a natural period of the pressure generating chamber.

* * * * *